US009149080B2

(12) United States Patent
Zhang

(10) Patent No.: US 9,149,080 B2
(45) Date of Patent: Oct. 6, 2015

(54) METHOD OF ATTACHING A FASTENING MEANS PAD TO A SIDEWING FOR A BRASSIERE, A SIDEWING AND FASTENING MEANS PAD FOR A BRASSIERE, AND A BRASSIERE COMPRISING THE SIDEWING AND FASTENING MEANS PAD

(71) Applicant: Wenbo Zhang, Kwai Chung (HK)

(72) Inventor: Wenbo Zhang, Kwai Chung (HK)

(73) Assignee: REGINA MIRACLE INTERNATIONAL (GROUP) LIMITED, Hong Kong (HK)

( * ) Notice: Subject to any disclaimer, the term of this patent is extended or adjusted under 35 U.S.C. 154(b) by 161 days.

(21) Appl. No.: 13/937,523

(22) Filed: Jul. 9, 2013

(65) Prior Publication Data

US 2015/0004876 A1 Jan. 1, 2015

(30) Foreign Application Priority Data

Jun. 28, 2013 (CN) ..... 2013 1 0268858

(51) Int. Cl.

| | |
|---|---|
| ***A41C 3/00*** | (2006.01) |
| ***A41F 1/00*** | (2006.01) |
| ***A41C 5/00*** | (2006.01) |
| ***A41C 3/12*** | (2006.01) |

(52) U.S. Cl.

CPC . *A41F 1/006* (2013.01); *A41C 3/12* (2013.01); *A41C 5/00* (2013.01)

(58) Field of Classification Search

CPC ..... A41C 3/00; A41C 3/0028; A41C 5/00
USPC ..... 450/39, 92, 93, 58, 1; 24/588.12, 592.1, 24/695, 697.2; 264/164, 145, 148, 160, 264/157, 257, 258, 292, 291, 294, 320, 264/321; 2/96, 78.1–78.4, 73
See application file for complete search history.

(56) References Cited

U.S. PATENT DOCUMENTS

| | | | | | |
|---|---|---|---|---|---|
| 2,664,571 | A | * | 1/1954 | Kempel | 450/57 |
| 2,834,352 | A | * | 5/1958 | Ullian | 450/57 |
| 2,867,818 | A | * | 1/1959 | Creamer | 623/7 |
| 2,896,631 | A | * | 7/1959 | Block | 450/51 |
| 3,528,140 | A | * | 9/1970 | Waldes | 24/695 |
| 3,620,222 | A | * | 11/1971 | Block | 450/57 |
| 3,772,899 | A | * | 11/1973 | Novi | 66/176 |

(Continued)

FOREIGN PATENT DOCUMENTS

| | | |
|---|---|---|
| CN | 201076018 Y | 6/2008 |
| JP | 2004-263315 | 9/2004 |

OTHER PUBLICATIONS

Chinese Office Action, dated Jun. 30, 2015 in corresponding Chinese Application No. 2013102688581. Includes English translation. Total 7 pages.

*Primary Examiner* — Gloria Hale
(74) *Attorney, Agent, or Firm* — Ostrolenk Faber LLP

(57) ABSTRACT

A method for attaching a fastening pad to a sidewing of a brassiere, a sidewing made according to the method and a brassiere with a sidewing made according to the method, the method includes attaching the fastening pad to a first sidewing piece of the sidewing, joining the perimeter of the fastening pad to a portion of a second sidewing piece of the sidewing, leaving a section of the perimeter of the fastening pad unjoined to the second sidewing piece and inverting the joined fastening pad and the second sidewing piece to expose the operative face of the fastening pad.

20 Claims, 4 Drawing Sheets

(56) References Cited

U.S. PATENT DOCUMENTS

| | | | | | |
|---|---|---|---|---|---|
| 4,008,029 | A * | 2/1977 | Shokite | 425/157 |
| 4,080,416 | A * | 3/1978 | Howard | 264/258 |
| 4,183,121 | A * | 1/1980 | Cousins | 24/588.1 |
| 4,202,853 | A * | 5/1980 | DiTullio | 264/138 |
| 4,250,137 | A * | 2/1981 | Riedler | 264/554 |
| 5,820,443 | A * | 10/1998 | Burr | 450/40 |
| 6,837,771 | B2 * | 1/2005 | Falla | 450/39 |
| 6,863,589 | B2 * | 3/2005 | Cano | 450/65 |
| 7,128,635 | B1 * | 10/2006 | Liu | 450/39 |
| 7,563,152 | B2 * | 7/2009 | Liu | 450/39 |
| 2004/0224604 | A1 * | 11/2004 | Luk | 450/39 |
| 2006/0105673 | A1 | 5/2006 | Lau | 450/39 |
| 2007/0066181 | A1 * | 3/2007 | Lau | 450/39 |

* cited by examiner

METHOD OF ATTACHING A FASTENING MEANS PAD TO A SIDEWING FOR A BRASSIERE, A SIDEWING AND FASTENING MEANS PAD FOR A BRASSIERE, AND A BRASSIERE COMPRISING THE SIDEWING AND FASTENING MEANS PAD

FIELD OF THE INVENTION

The present invention relates to a method of attaching a fastening means pad to a sidewing for a brassiere, a sidewing and fastening means pad for a brassiere, and a brassiere comprising the sidewing and fastening means pad.

BACKGROUND OF THE INVENTION

A brassiere may include a fastening means to connect and hold the brassiere around the wearer. Conventional fastening means comprise complementary interlocking rigid wire hooks and eyes. The hooks and eyes may be located on hook and eye pads respectively. The hook and eye pads are usually joined to sidewings of the brassiere which extend from the cups of the brassiere around the back of the wearer. The sidewings may also connect to straps which are worn over the shoulder to provide support to the cups of the brassiere.

Typically, the hook and eye pads are joined to the sidewings of a brassiere by sewing the hook or eyed pad to the free end of the sidewing. In such a manner of attachment the stitches are conspicuous and may also produce discomfort in the wearer due to the seams and uneven edges or surfaces.

U.S. Pat. No. 7,128,635 and U.S. Pat. No. 7,563,152 describe a hook or eye pad sandwiched between an outer layer and an inner layer of a brassiere wing. The hooks or eyes extend through apertures in the inner or outer layer of the brassiere wing to the exterior of the wing. Japanese Patent Application Publication number 2004-263315 describes a brassiere wing which folds around a hook or eye pad, with the hooks or eyes extending through apertures in the brassiere wing. Apertures formed in the layers of the brassiere sidewing may weaken the sidewing and make it more susceptible to damage during washing. In addition, the hooks or eyes could move back through the apertures, making fastening difficult.

It is an object of the present invention to overcome one or more of the above-described problems.

SUMMARY OF THE INVENTION

In a first aspect of the invention, there is provided a method of attaching a fastening means pad to a sidewing for a brassiere. The method comprises attaching the fastening means pad to a first sidewing piece, aligning a second sidewing piece with the first sidewing piece such that a portion of the second sidewing piece covers the operative face of the fastening means pad, joining the second sidewing piece to the fastening means pad along at least a portion of the perimeter of the fastening means pad, whilst leaving a section of the perimeter of the fastening means pad unjoined and inverting the joined fastening means pad and second sidewing piece through the unjoined section such that the operative face of the fastening means pad is exposed.

In one embodiment the second sidewing piece is similarly shaped to the first sidewing piece, and the method further comprises joining the second sidewing piece to the first sidewing piece along one or more of their corresponding edges adjacent the fastening means pad. Preferably the method further comprises folding in the one or more joined edges adjacent the fastening means pad towards the first sidewing piece and attaching the one or more folded in joined edges to the fastening means pad but not to the portion of the second sidewing piece that covers the operative face of the fastening means pad. Preferably, the joined fastening means pad and second sidewing piece are also inverted through an opening between the first and second sidewing pieces, where the edges have not been joined.

In an alternative preferred embodiment, the method further comprises joining one or more rubber strips to one or more of the edges of the first sidewing piece and/or second sidewing piece. The rubber strips are preferably positioned adjacent the fastening means pad and the method further comprises folding in the one or more joined edges with rubber strips adjacent the fastening means pad towards the first sidewing piece and attaching the one or more folded in joined edges to the fastening means pad but not to the portion of the second sidewing piece that covers the operative face of the fastening means pad.

In another embodiment of the method, the second sidewing piece consists of the portion of the second sidewing piece that covers the operative face of the fastening means pad. A third sidewing piece of similar shape to the first sidewing piece may be joined to the first sidewing piece along one or more of their corresponding edges.

In these embodiments, the fastening means pad may comprise a hook pad or the fastening means pad may comprise an eye pad.

In a second aspect of the invention there is provided a sidewing and fastening means pad for a brassiere. The sidewing comprises a first sidewing piece and a second sidewing piece, wherein the fastening means pad is attached to the first sidewing piece such that the operative face of the fastening means pad is exposed and the second sidewing piece is positioned on the non-operative side of the fastening means pad and is joined to the fastening means pad along at least a portion of the perimeter of the fastening means pad such that the surface of the second sidewing piece is seamless across the non-operative side of the fastening means pad.

Preferably, the first and second sidewing pieces are similarly shaped and joined to one another along one or more of their corresponding edges. The second sidewing piece may be stitched to the fastening means pad along at least a portion of the perimeter of the fastening means pad and the first and second sidewing pieces may be stitched together along one or more of their corresponding edges.

In another embodiment, the sidewing and fastening means pad for a brassiere further comprises one or more rubber strips positioned between the first and second sidewing pieces, along the one or more joined edges.

In another embodiment, the second sidewing piece consists of a piece that covers the operative face of the fastening means pad. In this embodiment, a third sidewing piece of similar shape to the first sidewing piece may be joined to the first sidewing piece along one or more of their corresponding edges.

In a third aspect of the invention there is provided a brassiere. The brassiere comprises two brassiere cups, at least one sidewing attached to a fastening means pad, the sidewing comprising a first sidewing piece and a second sidewing piece, wherein the fastening means pad is attached to the first sidewing piece such that the operative face of the fastening means pad is exposed and the second sidewing piece is positioned on the non-operative side of the fastening means pad and is joined to the fastening means pad along at least a portion of the perimeter of the fastening means pad such that the surface of the second sidewing piece is seamless across the non-operative side of the fastening means pad. Preferably, a section of the perimeter of the fastening means pad is unjoined to the second sidewing piece.

Preferably, the brassiere comprises two sidewings attached to two fastening means pads, wherein the fastening means pad attached to one sidewing is a hook pad and the fastening means pad attached to the other sidewing is an eye pad.

Also preferably, the fastening means pad attached to the inner sidewing is an eye pad and the fastening means pad attached to the outer sidewing is a hook pad.

The at least one sidewing may be attached to a fastening means pad in accordance with the methods described in the first aspect of the invention.

BRIEF DESCRIPTION OF THE DRAWINGS

The present invention will now be described in detail with reference to the accompanying drawings.

DETAILED DESCRIPTION OF THE INVENTION

The present invention relates to method of fixing a fastening means pad to a sidewing of a brassiere, a sidewing and fastening means pad for a brassiere, and a brassiere comprising such a sidewing and fastening means pad. A method of fixing a fastening means pad to a sidewing of a brassiere in accordance with a first preferred embodiment of the invention will now be described with reference to FIGS. 1, 2*a*, 3*a*, 4*a*, 4*b* and 5.

Figure 1:
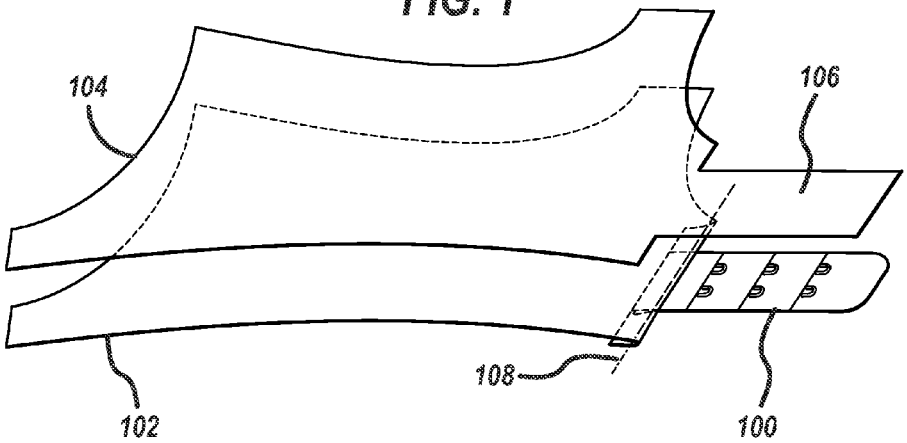
FIG. 1 is a perspective view of a first sidewing piece joined to a fastening means pad and a second sidewing piece according to an embodiment of the invention.

FIG. 1 is a view of a first sidewing piece 102, a second sidewing piece 104 and a fastening means pad 100. Fastening means pad 100 is depicted as an eye pad, although it will be appreciated that the eye pad depicted in the figures represents any appropriate fastening means pad and is, therefore, equally applicable to a hook pad. In the preferred embodiment, the fastening means pad 100 is joined to the first sidewing piece 102 along dotted line 108. This join is preferably formed by sewing, though may alternatively be formed by an adhesive, heating or ultrasonic welding. Preferably, the first and second sidewing pieces 102, 104 comprise fabric.

Once the fastening means pad 100 has been attached or joined to the first sidewing piece 102, the first sidewing piece 102 and second sidewing piece 104 are aligned such that the flap section 106 of the second sidewing piece 104 covers the operative face of the fastening means pad 100, i.e. the face of an eye pad on which the eyes are located and exposed, or the face of a hook pad on which the hooks are located and exposed.

Figure 2A:
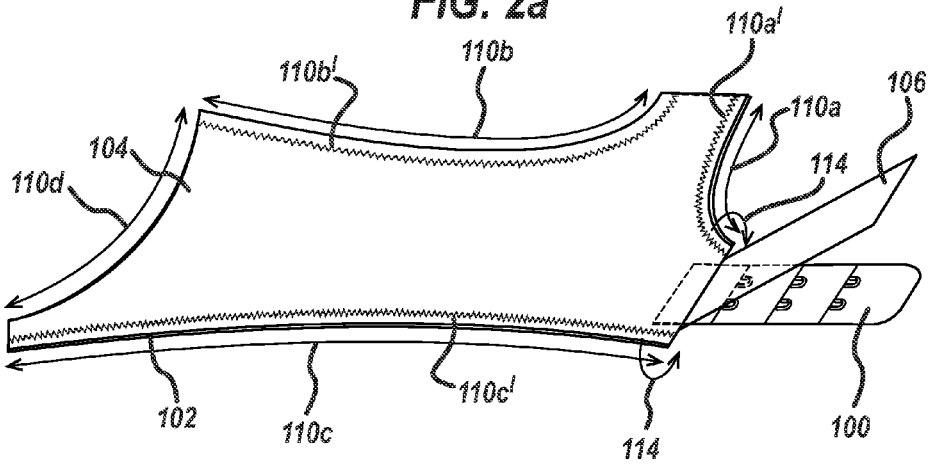
FIG. 2*a* is a perspective view of the sidewing and fastening means pad of FIG. 1, once the first and second sidewing pieces having been joined according to an embodiment of the invention.

In a first preferred embodiment, as depicted in FIG. 2*a*, the first sidewing piece 102 and the second sidewing piece 104 are joined along their edges 110*a*, 110*b* and 110*c*. Again, this join is preferably formed by sewing along lines 110*a*', 110*b*' and 110*c*', although may alternatively be formed by an adhesive, heating or ultrasonic welding.

Figure 3A:
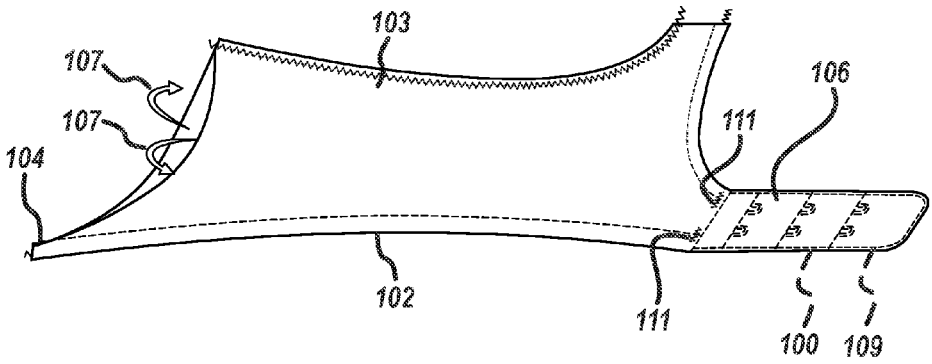
FIG. 3*a* is a perspective view of the sidewing and fastening means pad of FIG. 2*a*, once the second sidewing piece has been joined to the fastening means pad and edges of the joined first and second sidewing pieces have been folded in, in accordance with an embodiment of the invention.

FIG. 2*a* also shows arrows 114 which depict the folding of the joined first and second sidewing pieces 102, 104 at or near the join between the fastening means pad 100 and the first sidewing piece 102 such that the edges of the sidewing formed by folding align with the edges of the fastening means pad 100, as can be seen in FIG. 3*a*. Preferably, the folded portion is sewn to the fastening means pad 100 at joins 111, such that the sewing thread passes through the folded portions of fabric and the fastening means pad 100, but not through the second sidewing piece 104, such that there is no seam seen through the second sidewing piece 104 when the sidewing 103 is inverted (as described later). However, the folded pieces may be fixed in place to the fastening means pad 100 at this location by any other suitable means, such as adhesive or heating. By folding in the joined first and second sidewing pieces 102, 104 at or near the join between the fastening means pad 100 and the first sidewing piece 102, and attaching them to the fastening means pad 100, the shape and the structural integrity of the attachment between the sidewing 103 and the fastening means pad 100 may be improved in the finished sidewing and fastening means pad.

FIG. 3*a* depicts the sidewing 103 formed of the joined first sidewing piece 102 and second sidewing piece 104 of FIG. 2*a*. The flap section 106 of the second sidewing piece is joined to the fastening means pad 100 around a substantial portion 109 of the perimeter of the fastening means pad 100. The flap portion 106 is preferably joined to the fastening means pad 100 along the upper edge, the lower edge and the distal free edge of the fastening means pad 100, as shown by line 109, leaving the section of the perimeter of the fastening means 100 pad which is joined to the first sidewing piece 102 unjoined to the flap portion 106. This creates an opening between the fastening means pad 100 and the flap section 106, through which the fastening means pad 100 can be passed when the sidewing 103 is inverted, as will be described later.

In the first preferred embodiment of the method of the present invention, the sidewing 103 is then inverted, as depicted by arrows 107, through the opening between the unjoined edges 110*d* of the first and second sidewing pieces 102, 104. The inversion results in the operative face of the fastening means pad 100, which was covered by the flap section 106 of the second sidewing piece 104, being inverted through the unjoined section of the flap portion 106 and the fastening means pad 100, to expose the operative face of the fastening means pad 100.

Figure 4A:
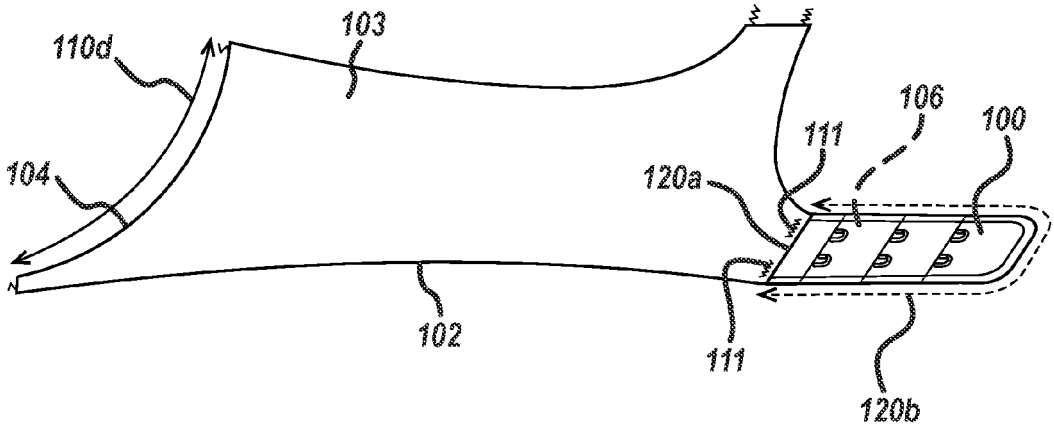
FIGS. 4*a* and 4*b* are perspective views of the completed sidewing and fastening means pad for a brassiere according to an embodiment of the invention.
Figure 4B:
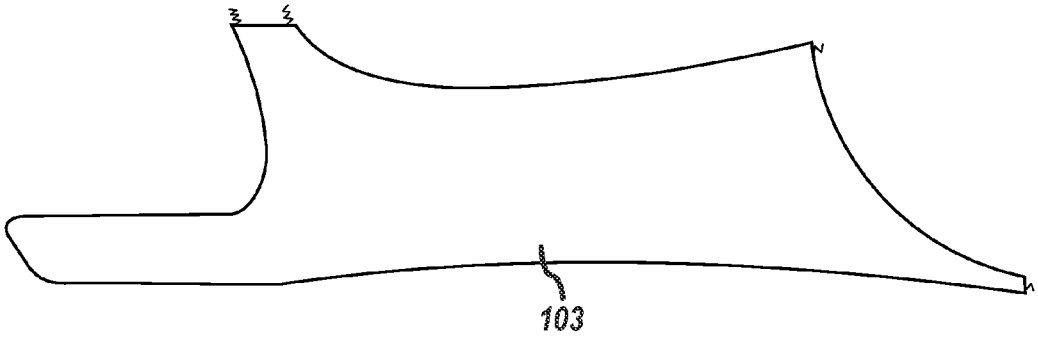

FIG. 4*a* depicts the completed sidewing 103 and fastening means pad 100, made according to the first preferred method of the present invention. The operative face of the fastening means pad 100 is exposed. FIG. 4*b* depicts the same sidewing 103 and fastening means pad 100 from the opposing side. As is depicted in FIG. 4*b*, the sidewing 103 made in accordance with the preferred method has no seams on a surface of the sidewing and such surface of the side wing 103 extends continuously over the fastening means pad 100. This surface of the sidewing depicted in FIG. 4*b* is seamless, with a smooth appearance and touch.

Figure 2B:
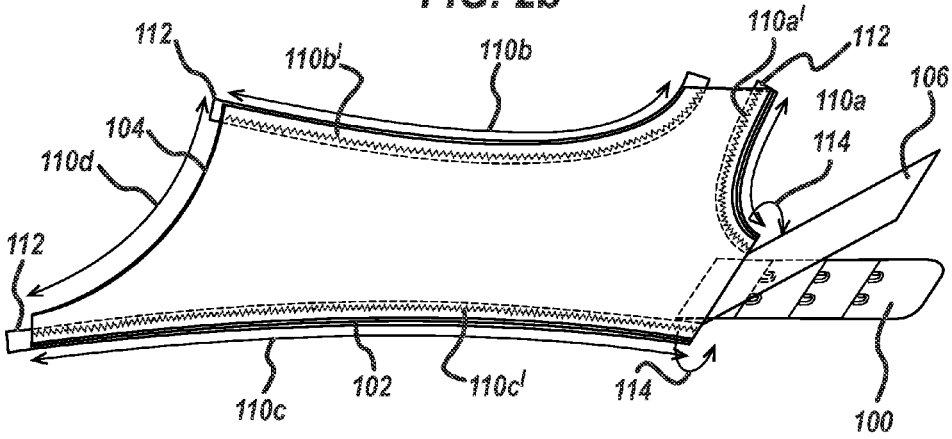
FIG. 2*b* is a perspective view of the sidewing and fastening means pad of FIG. 1, once the first and second sidewing pieces having been joined with rubber strips in accordance with another embodiment of the invention.

A second preferred method of the present invention relates to a modification of the first preferred method, in which, as depicted in FIG. 2*b*, rubber strips 112 are joined to the first and second sidewing pieces 102, 104 along the join between the first and second sidewing pieces to provide improved elasticity to the completed sidewing 103. Preferably, the rubber strips 112 are attached to the outside surface of the first sidewing piece 102 or the second sidewing piece 104 such that once the sidewing is inverted, the rubber strips are located on the inside of the brassiere. Preferably, although not essentially, the rubber strips 112, first sidewing piece 102 and second sidewing piece 104 are joined together in a single joining step, e.g. by a single stitching step, at 110*a*', 110*b*' and 110*c*'. All other steps of the method remain unchanged from those described in the first preferred method. In particular, FIG. 2*b* also shows arrows 114 indicating the step of folding in the edges of the joined first and second sidewing pieces 102, 104 at or near the join between the fastening means pad 100 and the first sidewing piece 102 such that the edges of the sidewing 103 formed by folding, align with the edges of the fastening means pad 100. The step of folding and attaching the folded piece to the fastening means pad 100 is as described above in relation to the first preferred method. However, this time, the folded portion also comprises the rubber strip 112. Preferably, the rubber strips 112 are attached to the outer surface of the first sidewing piece 102, such that the rubber strips 112 faces in towards the fastening means pad 100 and first sidewing piece 102 when folded inwards.

Figure 3B:
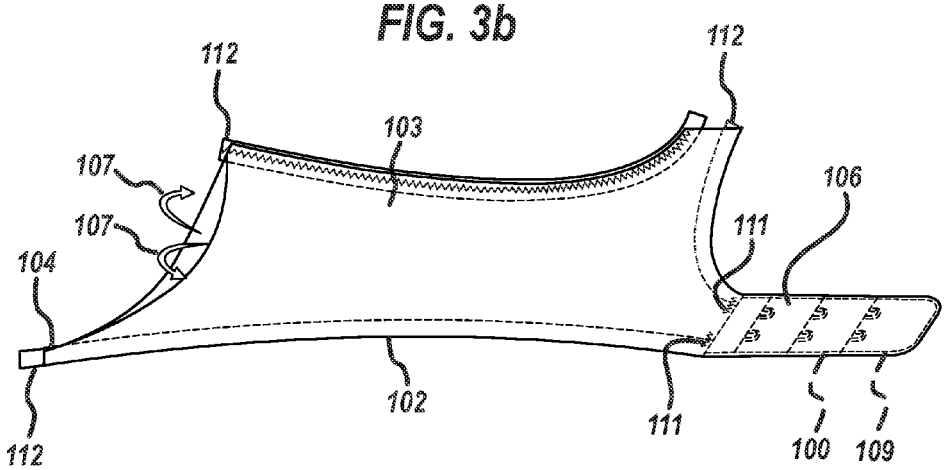
FIG. 3*b* is a perspective view of the sidewing and fastening means pad of FIG. 2*b*, once the second sidewing piece has been joined to the fastening means pad and edges of the joined first and second sidewing pieces have been folded in, in accordance with an embodiment of the invention.

FIG. 3*b* depicts the sidewing 103 formed of the joined first sidewing piece 102 and second sidewing piece 104 and the rubber strips 112 of FIG. 2*b*. The flap section 106 of the second sidewing piece is joined to the fastening means pad 100 in the same manner as described with regard to FIG. 3*a*. In the same way as described in relation to FIG. 3*a*, the sidewing 103 is then inverted, as depicted by arrows 107, through the opening between the unjoined edges 110*d* of the first and second sidewing pieces 102, 104. The inversion results in the operative face of the fastening means pad 100, which was covered by the flap section 106 of the second sidewing piece 104, being inverted through the unjoined section of the flap portion 106 and the fastening means pad 100, to expose the operative face of the fastening means pad 100. FIGS. 4*a* and 4*b* depict the completed sidewing 103 and fastening means pad 100 made according to the second preferred method of the present invention. The completed sidewing 103 and fastening means pad 100 looks the same as the version without rubber strips, as described in accordance with FIGS. 2*a* and 3*a*.

In alternative embodiments of the method of the invention, the steps of the above described methods may occur in a different order to those described. By way of non-limiting example, the step of joining the flap section 106 of the second sidewing piece 104 to the fastening means pad 100 may occur before the step of joining the edges of the first and second sidewing pieces 102, 104 together. Furthermore, in other embodiments of the method of the invention one or more of the steps may be omitted. By way of non-limiting example, the step of folding over the joined edges of the first and second sidewing pieces 102, 104 and attaching the folded portion to the fastening means pad 100 at join 111 may be omitted.

In another embodiment of method of the present invention, the second sidewing piece may comprise the flap section 106 only. This will still result in a seamless surface on the reverse or the non-operative side of the fastening means pad 100 in the finished product (but that seamless surface will not be continuous across the fastening means pad). In such an embodiment, the sidewing 103 is inverted through the opening between the flap section 106 and the fastening means pad 100 at the unjoined section of the fastening means pad 100 to the flap section 106. A third sidewing piece of similar shape to the first sidewing piece 102 may be joined to the first sidewing piece 102 along their upper 110*a*, 110*b* and lower 110*c* edges. The third sidewing piece may be joined to the first sidewing piece before or after the operative face of the fastening means pad 100 is exposed by inverting the sidewing 103. It may be preferable for the second and third sidewing pieces to overlap.

The preceding discussion of joining edges 110*a*, 110*b*, 110*c* of the sidewing pieces relates to a specific embodiment with a sidewing 103 having a specific geometry. This geometry may differ for different styles of brassiere, such as strapless brassieres where the sidewings may only have one edge where the sidewing depicted in FIGS. 2*a* and 2*b* has edges 110*a* and 110*b*. Differing geometries of brassiere sidewing are encompassed by the methods of the present invention, provided that the second sidewing piece 104 has a flap section 106 which is appropriately sized to cover the operative face of the fastening means pad 100.

In the methods described above, the section of the perimeter of the sidewing which is joined to the brassiere cup is left unjoined so that the sidewing may be inverted through it. However, in other embodiments of the methods of the invention any one of the edges may be left unjoined, for example edges 110*b*, 110*c* and 110*d* may be joined and 110*a* unjoined. Alternatively, all edges may be left unjoined, or two edges may be joined and two unjoined, or one edge joined and three unjoined.

Figure 5:
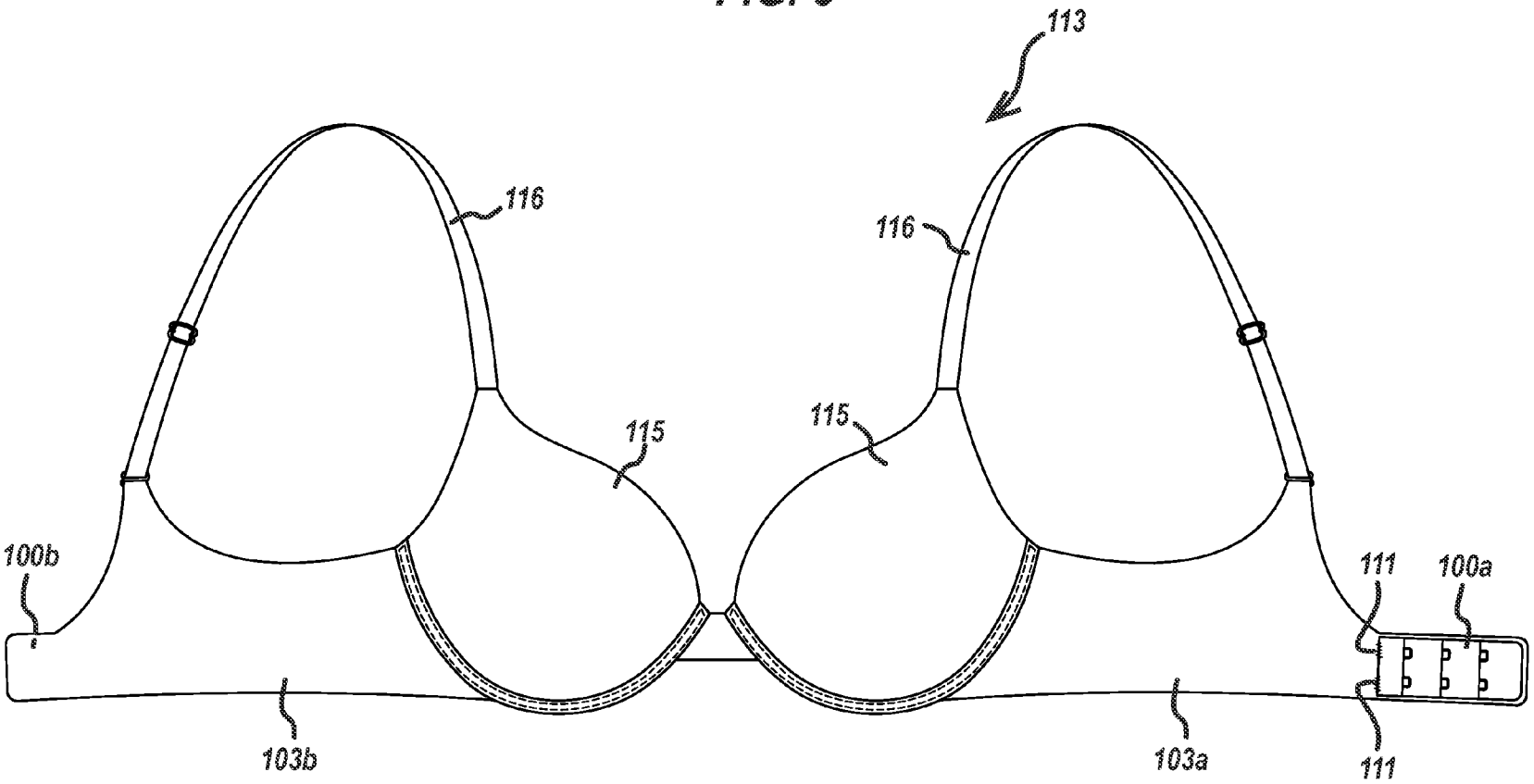
FIG. 5 is a perspective view of a completed brassiere according to an embodiment of the invention.

The present invention also comprises a method of manufacturing a brassiere. FIG. 5 depicts a completed brassiere 113 made according to this method. As previously discussed, the method of attaching a fastening means pad to a sidewing is suitable for producing a sidewing 103 attached to any fastening means pad 100, for example hook pads or eye pads. The method of manufacturing a brassiere comprises attaching two sidewings 103 to fastening means pads 100 as described above. The sidewings 103 so formed are then joined to the cups 115 of the brassiere 113 along edge 110*d* and straps 116 may be connected to the sidewings 103 between edges 110*a* and 110*b*. The strap may be connected to a loop of fabric formed by folding over the section of sidewing 103 between edges 110*a* and 110*b* and joining this folded section to the sidewing.

In the preferred embodiment of manufacturing a brassiere, both sidewings 103*a* and 103*b* are formed and attached to fastening means pads 100 according to the methods described above. Sidewing 103*a* is the inner sidewing since the fastening means pad 100*a* is adjacent to the skin of the wearer when in use. The sidewing 103*b* is the outer sidewing. It is an advantage of the seamless surface on the side of the sidewings 103 depicted in FIG. 4*b* that both a smooth appearance and smooth touch are produced. In the case of the inner sidewing 103*a*, this results in a more comfortable fit of the brassiere 113 against the skin of the wearer, since there are no seams to irritate the skin. In the case of the outer sidewing 103*b*, this has an improved aesthetic.

In an alternative method of producing a brassiere, only one sidewing 103*a* or 103*b* of the brassiere 113 is formed and attached to a fastening means pad by the method of attaching a fastening means pad to a sidewing as described above. The other sidewing may be attached to a fastening means pad in a traditional manner. Such an arrangement can still provide an improved comfort (if the inner sidewing and fastening means pad is manufactured in accordance with the present invention) or improved appearance (if the outer sidewing and fastening means pad is manufactured in accordance with the present invention).

Sidewings and fastening means pads and a brassiere in accordance with preferred embodiments of the present invention are depicted in FIGS. 4*a*, 4*b* and 5.

FIG. 4*a* depicts a sidewing 103 formed of a first sidewing piece 102 and a second sidewing piece 104 and a fastening means pad 100. The fastening means pad 100 is joined to the first sidewing piece 102 along edge 120*a* and is joined to the second sidewing piece 104 along perimeter 120*b*. The first sidewing piece 102 and the second sidewing piece 104 are joined together along the perimeter excepting edges 120*a* and 110*d*. The joins between the first sidewing piece 102, second sidewing piece 104 and fastening means pad 100 are positioned such that the surface of the sidewing formed by the second sidewing piece 104, as depicted in FIG. 4*b*, does not have any seams and is continuous across the fastening means pad 100. The sidewings with attached fastening means pads 100 of the present invention are preferably made in accordance with one of the methods described previously.

FIG. 5 depicts a brassiere 113 according to a preferred embodiment of the invention having two brassiere cups 115, straps 116, two sidewings 103*a* and 103*b* each having complementary fastening means pad 100*a* or 100*b*. The sidewings 103*a* and 103*b* are joined to the brassiere cups 115 and optionally straps 116. The seamless surface of the second sidewing piece of the inner sidewing 103*a* lies against the skin of the wearer providing a more comfortable brassiere. The seamless surface of the second sidewing piece of the outer sidewing 103*b* lies facing away from the skin of the user and provides an improved appearance. Preferably, the fastening means pad 100*a* of the inner sidewing 103*a* is an eye pad and the fastening means pad 100*b* of the outer sidewing 103*b* is a hook pad.

In an alternative embodiment of the brassiere of the present invention, the second sidewing piece 104 of sidewing 103 may be a section of fabric which covers the reverse or the non-operative face of the fastening means pad 100 only. In this embodiment, there may be a third sidewing piece joined to the first sidewing piece 102 as described previously in relation to the method of manufacturing a sidewing.

In the preferred embodiment of the brassiere of the present invention, the brassiere has two sidewings 103*a* and 103*b* with complementary fastening means pads 100*a* and 100*b* which are attached to the sidewings as described above. In other embodiments, it may be that only one sidewing 103*a* or 103*b* of the brassiere 113 is attached to a fastening means pad 100 as described above, with the other sidewing being formed in a traditional manner. Such an arrangement still has an advantageous effect of improved comfort or improved appearance.

It will be appreciated that this description is by way of example only; alterations and modifications may be made to the described embodiment without departing from the scope of the invention as defined in the claims.

The invention claimed is:

1. A method of constructing a sidewing of a brassiere having a fastening pad, the sidewing including a first sidewing piece and a second sidewing piece, the first and the second sidewing pieces forming first and second sides of the sidewing, the method comprising:

attaching the fastening pad to the first sidewing piece along a first section of a perimeter of the fastening pad;

aligning the second sidewing piece with the first sidewing piece such that a portion of the second sidewing piece covers an operative face of the fastening pad, the operative face including at least one fastening element thereon;

joining the portion of the second sidewing piece that covers the operative face of the fastening pad to the fastening pad along a second section of the perimeter of the fastening pad, the second section including an unjoined section that is not joined to the second sidewing piece to define an opening between the second sidewing piece and the fastening pad; and inverting the joined fastening pad and the portion of the second sidewing piece that is joined to the second section of the fastening pad by passing the second section of the perimeter of the fastening pad through the opening to expose the operative face of the fastening pad.

2. The method of claim 1, wherein the second sidewing piece and the first sidewing piece have corresponding edges, and the method further comprises joining the second sidewing piece to the first sidewing piece along the corresponding edges adjacent the fastening pad.

3. The method of claim 2, further comprising folding in the joined edges of the first and the second sidewing pieces that are adjacent the fastening pad towards the first sidewing piece and attaching the folded in joined edges to the fastening pad.

4. The method of claim 2, further comprising joining one or more rubber strips to one or more of the edges of the first sidewing piece and/or the second sidewing piece.

5. The method of claim 4, wherein the rubber strips are positioned adjacent the fastening pad and the method further comprises folding in the joined edges with rubber strips adjacent the fastening pad towards the first sidewing piece and attaching the one or more folded in joined edges to the fastening pad.

6. The method of claim 1, wherein the second sidewing piece only covers the operative face of the fastening pad.

7. The method of claim 1, wherein the second sidewing piece includes the portion that covers the operative face of the fastening pad and a third sidewing piece, and further comprising joining the third sidewing piece to the first sidewing piece.

8. The method of claim 2, wherein the joined fastening pad and second sidewing piece are also inverted through an opening between the first and second sidewing pieces, where the edges have not been joined.

9. The method of any of claim 1, wherein the fastening element is a hook.

10. The method of any of claim 1, wherein the fastening element is an eye.

11. A brassiere sidewing comprising a first sidewing piece forming a first side of the sidewing, a second sidewing piece forming a second side of the sidewing, and a fastening pad attached to the sidewing, wherein:

the fastening pad has a perimeter and is attached to the first sidewing piece along a first section of the perimeter such that an operative face of the fastening pad is exposed, the operative face having at least one fastening element thereon;

the second sidewing piece is positioned on a non-operative side of the fastening pad opposite the operative face, and the second sidewing piece is joined to the fastening pad along at least a second section of the perimeter of the fastening pad such that an exterior surface of the second sidewing piece is seamless across the non-operative side of the fastening pad.

12. The sidewing and fastening pad for a brassiere according to claim 11, wherein the first and the second sidewing pieces have corresponding edges and are joined to one another along their corresponding edges.

13. The sidewing and fastening pad of claim 12, wherein the second sidewing piece is joined to the fastening pad by stitches and the first and second sidewing pieces are joined by stitches.

14. The sidewing and fastening pad of claim 12, further comprising one or more rubber strips positioned between the first and the second sidewing pieces, along the one or more joined edges.

15. The sidewing and fastening pad of claim 11, wherein the second sidewing piece only covers the fastening pad.

16. The sidewing and fastening pad of claim 15, wherein a third sidewing having edges corresponding to the edges of the first sidewing piece is joined to corresponding edges of the first sidewing piece.

17. A brassiere comprising:

two brassiere cups;

a first sidewing and a second sidewing, at least one of the sidewings comprising a first sidewing piece, a second sidewing piece and a fastening pad, the first and the second sidewing pieces including first and second faces of the at least one sidewing, wherein:

the fastening pad has a perimeter and is attached to the first sidewing piece along a first section of the perimeter such that an operative face of the fastening pad is exposed, the operative face including at least one fastening element;

the second sidewing piece is positioned on a non-operative side of the fastening pad opposite the operative face and is joined to the fastening pad along at least a second section of the perimeter of the fastening pad such that an exterior surface of the second sidewing piece is seamless across the non-operative side of the fastening pad.

18. The brassiere of claim 17, wherein the second section of the perimeter of the fastening pad is unjoined to the second sidewing piece.

19. The brassiere of claim 17, wherein the fastening element is either an eye or a hook.

20. A brassiere having a sidewing constructed in accordance with the method of claim 1.

* * * * *